United States Patent [19]

Maeda

[11] Patent Number: 4,474,360

[45] Date of Patent: Oct. 2, 1984

[54] IDLING DEVICE FOR LEVER HOIST

[75] Inventor: Kazuo Maeda, Yokohama, Japan

[73] Assignee: Kabushiki Kaisha Kito, Kawasaki, Japan

[21] Appl. No.: 473,302

[22] Filed: Mar. 8, 1983

[30] Foreign Application Priority Data

Jun. 9, 1982 [JP] Japan ..... 57-97577

[51] Int. Cl.[3] ..... B66D 1/14; B66D 1/42

[52] U.S. Cl. ..... 254/350; 254/353; 254/357; 254/372

[58] Field of Search ..... 254/217, 218, 350, 352, 254/353, 354, 369, 376, 372

[56] References Cited

U.S. PATENT DOCUMENTS

| | | | |
|---|---|---|---|
| 3,047,114 | 7/1962 | Stevens | 254/352 X |
| 3,100,031 | 8/1963 | Lock | 254/352 X |
| 3,776,514 | 12/1973 | Eggleton | 254/369 |

*Primary Examiner*—Stuart S. Levy
*Assistant Examiner*—Joseph J. Hail, III
*Attorney, Agent, or Firm*—Sughrue, Mion, Zinn, Macpeak, and Seas

[57] ABSTRACT

An idling device is able to bring a lever hoist into an idling condition including a change gear provided on driving member threadedly engaged on a driving shaft for driving a sheave for winding-up a chain or rope for a load, an operating lever rockably driven by a hand, winding-up and winding-off driving pawls engageable with teeth of the change gear and changeable for hoisting or lowering the load, and a braking assembly for preventing the change gear from being driven by the gravitational force of the load and adapted to be clamped and released by rotative movement of the driving member relative to the driving shaft. According to the invention, the idling device comprises an anchoring member fixed at one end of the driving shaft, a manually operatable knob rotatably and axially slidably fitted on the driving shaft between the anchoring member and the driving member for manually driving the driving member from a brake clamping position to a brake releasing position, and anchor operating member fitted in an aperture formed in the knob and radially slidable therein toward and away from the anchoring member to clamp and release the knob relative to the driving shaft, thus enabling the lever hoist braking assembly to be maintained in the released condition and to be changed from the released condition into the clamped condition.

3 Claims, 5 Drawing Figures

IDLING DEVICE FOR LEVER HOIST

BACKGROUND OF THE INVENTION

1. Field of the Invention

The present invention relates to an idling device for a lever hoist capable of maintaining its braking assembly in a released condition during idling operation of the hoist but making the assembly clamped or operative in lifting and lowering a load.

2. Description of the Prior Art

Idling devices for lever-operated small type hoisting and dragging devices have been known. One of the devices includes a spring interposed between a driving member repeatedly driven by a lever and a driven member of a braking assembly for releasing a braking assembly.

With the known device, since a spring force always acts in a direction releasing the braking assembly, a clamping force for the braking assembly is insufficient when a light load is being hoisted. In hoisting such a light load, therefore, when the lever is repeatedly rocked, the driving member is returned by a return movement of the lever for a next driving movement. Accordingly, such a device cannot hoist a light load. In lowering a light load, on the other hand, a torque resulting from the light load turns a load sheave to cause the load to drop, with the result that such a light load cannot be lowered by the rocking movement of the lever.

SUMMARY OF THE INVENTION

It is an object of the invention to provide an improved idling device for a lever hoist which eliminates the above disadvantages of the prior art and is capable of lifting and lowering even a light load by repeatedly rocking a lever by providing means for holding a released braking assembly.

An idling device for a lever hoist according to this invention includes a change gear provided on a driving member threadedly engaged on a driving shaft for driving a sheave winding up a chain, rope or the like thereabout for a load. An operating lever is rockable about said driving member by a hand. A winding-up driving pawl engages with teeth of said change gear and is driven by said operating lever in a winding-up direction for the load. A winding-off driving pawl is engageable with the teeth of said change gear and is driven by said operating lever in a winding-off direction for the load. A braking assembly prevents the change gear from being driven from a side of said sheave and being clamped and released by rotative movement of said driving member relative to said driving shaft. An anchoring member is fixed to said driving shaft, a manually operatable knob for manually driving said driving member from a brake clamping position to a brake releasing position and vice versa, and anchor operating means are engageable with said anchoring member to clamp said knob relative to said driving shaft.

The invention will be more fully understood by referring to the following detailed specification and claims taken in connection with the appended drawings.

DETAILED DESCRIPTION OF THE PREFERRED EMBODIMENT

Figure 1:
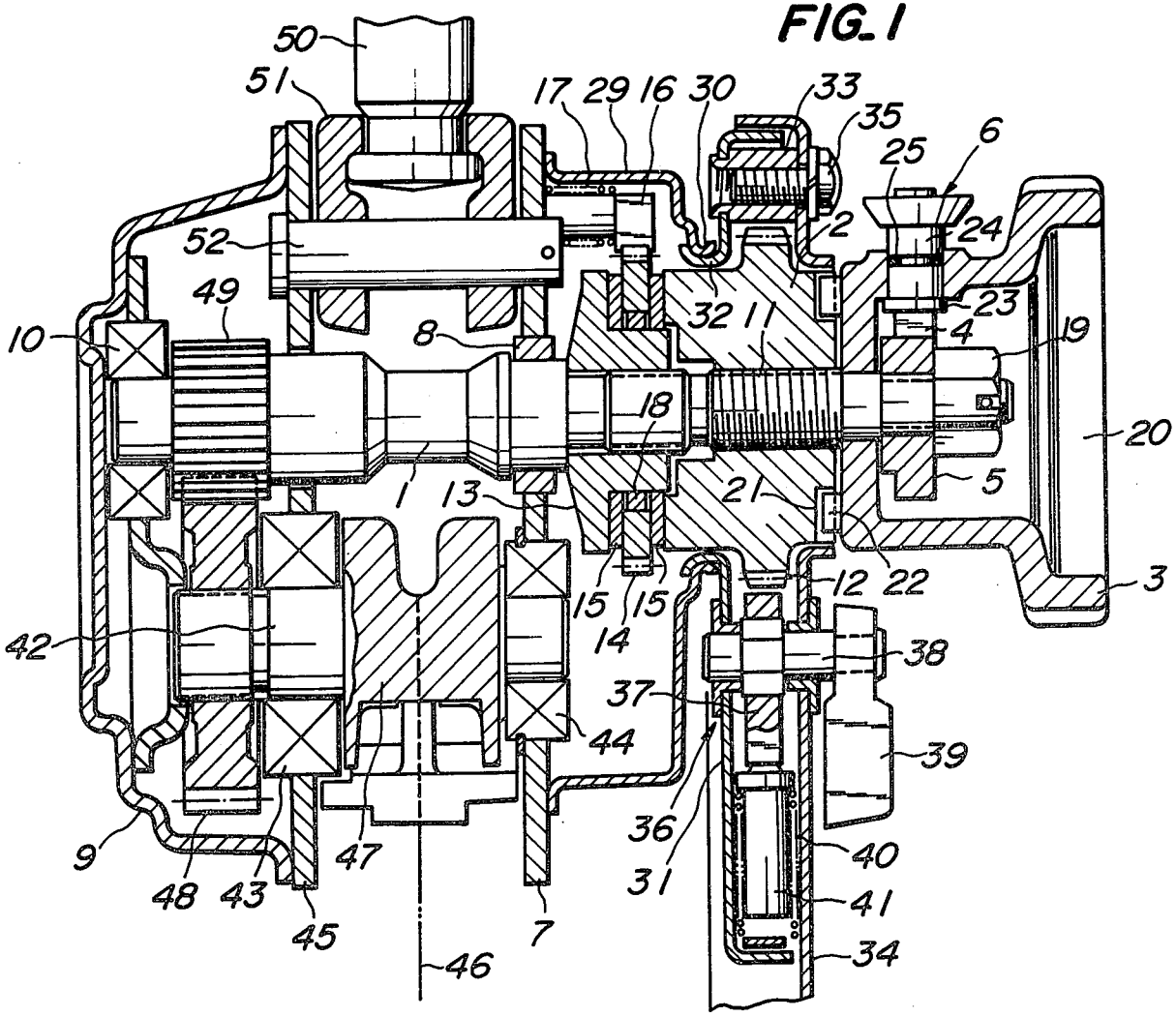
FIG. 1 is a sectional view of a part of a lever hoist under an operated condition provided with an idling device according to the invention.

Referring to FIGS. 1–6 illustrating one embodiment of the invention, a driving shaft 1 is journaled at its mid portion by a bearing 8 in a frame 7 and has a front end (left end as viewed in FIG. 1) journaled by a bearing 10 in a gear box 9 and a rear portion formed with external screw threads 11 for a braking assembly adapted to be threadedly engaged with internal screw threads of a driving member 2 having change gear teeth 12. A driven member 13 is also fitted on the driving shaft 1 against rotation relative thereto between the frame 7 and driving member 2 and abuts against an enlarged diameter portion of the driving shaft 1 journaled by the bearing 8.

In the specification, the word "front" or "forward" means the side of a sheave of the lever hoist or the left side as viewed in FIG. 1, while the word "rear" means the side of an operating lever or the right side as viewed in FIG. 1.

Between the driving member 2 and the driven member 13 are interposed a brake ratchet wheel 14 and friction plates 15 abutting against opposite sides thereof. A brake pawl 16 pivotally secured to the frame 7 is brought into engagement with the brake ratchet wheel 14 by an engagement spring 17. The brake ratchet wheel 14 has a center hole within which is fitted an oilless bearing 18 of a sintered alloy. The ratchet wheel 14, friction plates 15 and bearing 18 are fitted on a reduced diameter portion of the driven member 13 to form a braking assembly. In hoisting and lowering a heavy load, the driving shaft 1 tends to be rotated by gravity acting on the load, so that when the driving shaft 1 is rotated, the driving member 2 is moved toward the braking assembly or to the left as viewed in FIG. 1 because of the threaded engagement of the driving shaft 1 and driving member 2. Accordingly, the driving member 2 urges the ratchet wheel 14 and friction plates 15 against the driven member 13 so that the driving shaft 1 is prevented from rotating with the aid of the brake pawl 16 connected to the frame 7.

Figure 2:
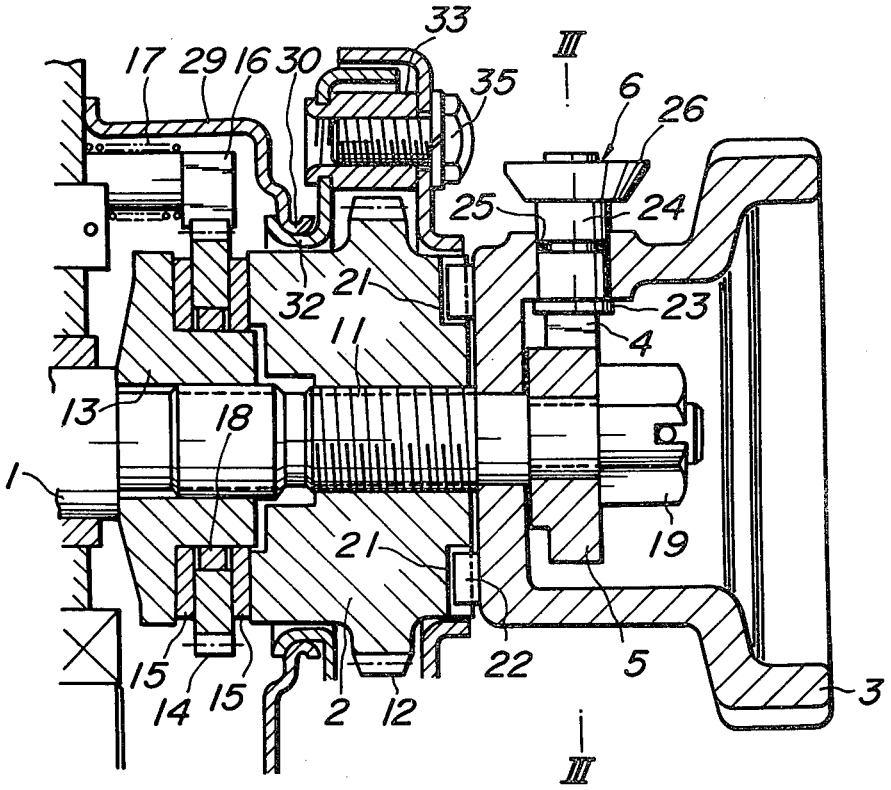
FIG. 2 is an enlarged sectional view of a part of the lever hoist shown in FIG. 1.

An anchoring member 5 is formed in its circumferential surface with a holding groove 4 for holding the released braking assembly and is fitted on a reduced diameter portion of the driving shaft 1 at its rear or right end as viewed in FIGS. 1 and 2 against rotation and fixed thereto by means of a nut 19 and a split pin. A manually operatable box-shaped knob 3 for manually quickly rotating the driving member is formed with a cavity 20 for receiving the anchoring member 5, the nut 19 and the like and is rotatably fitted on the driving shaft 1 between the driving and anchoring members 2 and 5. There is a clearance between the driving member 2 and the knob 3 for permitting the release of the braking assembly. The driving member 2 is formed with engagement recesses 21 in its rear end surface, which receive therein engagement protrusions 22 formed on a front end surface of the knob 3 to form a rotative movement transmission portion for transmitting the rotative movement between the driving member 2 and the knob 3.

Figure 3:
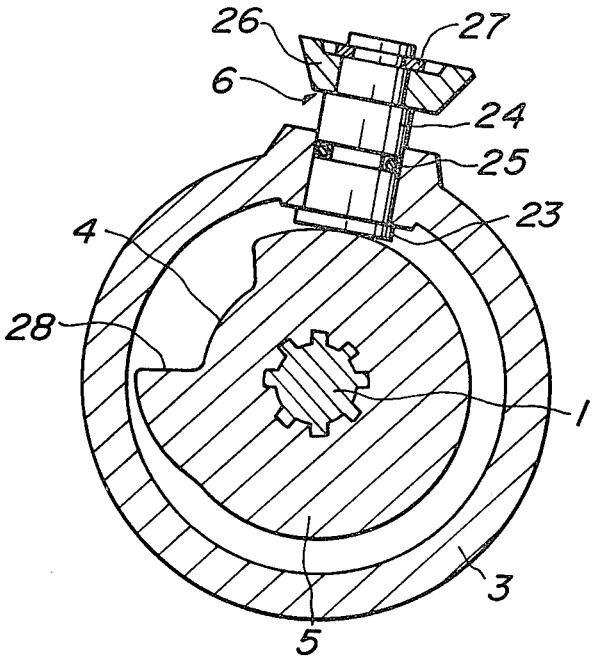
FIG. 3 is a sectional view taken along a line III—III in FIG. 2.
Figure 4:
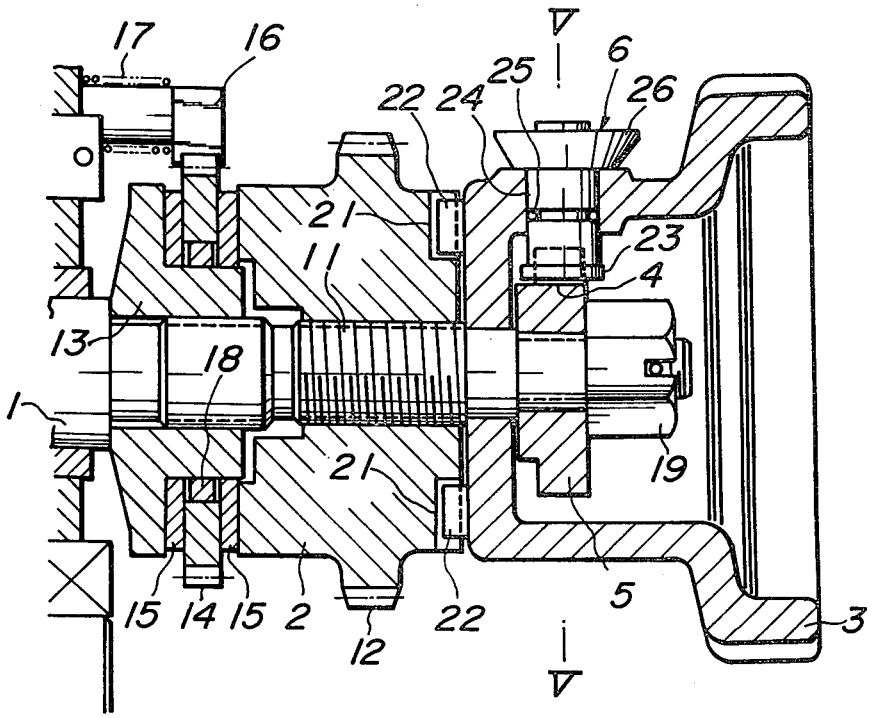
FIG. 4 is a sectional view similar to FIG. 2 but the idling device under an idling condition according to the invention.
Figure 5:
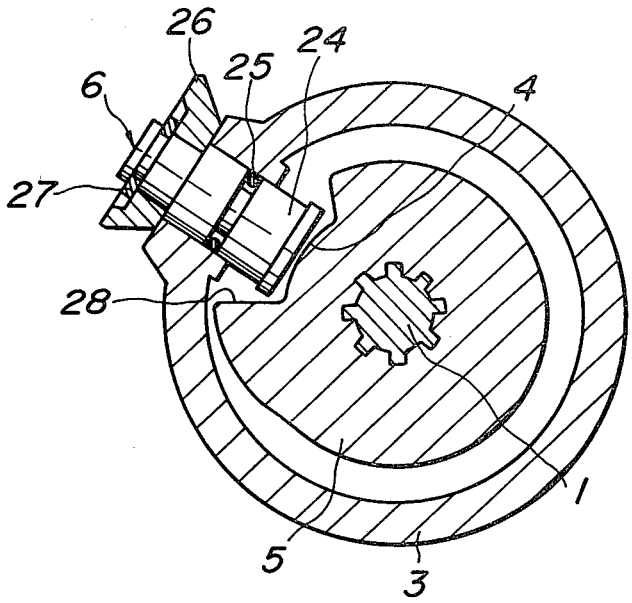
FIG. 5 is a sectional view taken along a line V—V in FIG. 5.

A rod 24 having a flange 23 at its inner end for preventing the rod 24 from separating from the knob 3 is fitted in an aperture formed in a circumferential wall of the knob 3 radially slidably relative thereto and in opposition to a circumference of the anchoring member 5. The rod 24 is formed at its mid portion with an annular groove for receiving a friction increasing member 25 such as a partially cut-off annular metal spring forcedly fitted in the aperture of the knob 3 for fitting the rod 24. The rod 24 is further formed at its outer end with a reduced diameter portion onto which is fitted an annular grip 26 fixed thereat by means of a snap ring or circlip 27 (FIG. 3). The rod 24 having the flange 23 and the grip 26 fixed to the rod 24 form anchor operating means 6. When the knob 3 is rotated to a brake release position and the anchor operating means 6 assumes in opposition to the holding groove 4, the inner end of the anchor oerating member 6 abuts against an outer edge of a sidewall of the groove 4 radially outwardly extending from a bottom of the groove 4.

The driven member 13, brake ratchet wheel 14, friction plates 15, brake pawl 16 and front part of the driving member 2 are covered by a metal brake cover 29 formed on its rear side by pressforming with a fixed support ring 30 having a U-shaped cross-section in opposition to an outer intermediate circumferential surface of the driving member 2. An inner lever component member 31 made of metal plates is formed by pressforming with a rotatable support ring 32 on its intermediate portion adjacent to the brake cover 29. The support ring 32 is adapted to be fitted in the fixed support ring 30 rotatable but against axial movement relative thereto in a manner enclosing the support ring 30, thereby supporting the inner lever component member 31 by the brake cover 29 rotatably but against axial movement. Cylindrical spacers 33 having internal screw threads are fitted and fixed by calking in apertures of the bottom portion of inner and outer lever component members 31 and 34 which are joined by connecting bolts 35 threadedly engaged within the spacers 33 to form an operating lever 36 rockable about a center line of the change gear 12.

The brake cover 29 is fixed on its side opposite to the fixed support ring 30 to the frame 7 by means of bolts (not shown). A handle or knob 39 is fixed to a pivot shaft 38 rotatably supported in the operating lever 36. To the pivot shaft 38 rotatably supported in the operating lever 36 is fixed a change pawl metal 37 including a winding-up direction driving pawl and a winding-off direction driving pawl which are detachably engageable with the change gear 12 and a winding-up direction holding engagement portion, a winding-off direction holding engagement portion and a neutral position holding engagement portion. The change pawl metal 37 engages a holding member 41 adapted to be urged thereto by means of an engagement or urging spring 40.

A driven shaft 42 is arranged in parallel with and under the driving shaft 1. A mid portion of the driven shaft 42 is journaled in a bearing 43 in a frame 45 closing an opening of a gear box 9 and a rear end of the shaft 42 is journaled in a bearing 44 in the frame 7. The driven shaft 42 is formed integrally with a load sheave 47 between the frames 7 and 45 for winding a chain 46 (symbolically shown in a chain line in FIG. 1) thereabout. In the gear box 9, the driven shaft 42 is provided with a large gear 48 fixed thereto adapted to engage a pinion 49 formed in the front end of the driving shaft 1.

In FIG. 1, an upper hook 50 is anchored to a hook support metal 51 mounted on a support rod 52 extending between the frames 7 and 45.

In carrying out the invention, different from the above embodiment, an anchoring member 5 may be provided in position with a holding protrusion and an anchor operating means may be provided at its inner end with a recess for receiving the holding protrusion. Moreover, engagement protrusions may be formed on the driving member 2, while engagement recesses may be formed in the knob 3 to form a rotative movement transmission portion for transmitting the rotative movement therebetween. Furthermore, a rubber ring may be used as the friction increasing member instead of the annular spring.

Moreover, the driving member 2 and the knob 3 may be integrally formed in a unitary member. In this case, the maximum external diameter of the knob 3 must be smaller than the inner diameter of the boss of the outer lever component member 34 and there must be a clearance between a front surface of the anchoring member 5 and a rear surface of the fitted portion of the knob 3 on the driving shaft 1 for permitting the release of the braking assembly.

According to the invention, starting from a condition wherein the driving shaft 1 is held so as not to rotate by gripping the load chain 46 or other means, the knob 3 together with the driving member 2 is rotated in a brake releasing direction to bring the anchor operating means 6 fitted in the knob 3 into alignment with the holding groove 4 of the anchoring member 5 and then the anchor operating means 6 is forced into and engaged with the holding groove 4. In this manner, the braking assembly can be securely kept in the released condition, so that the idling operation of the hoist can be effected by rotating the knob 3 or pulling the load chain 46. Moreover, after the anchor operating means 6 is removed from the holding groove 4 of the anchoring member 5, the knob 3 is rotated in a brake clamping direction, so that the braking assembly is changed from the idling or released condition into the clamped or operating condition, thereby lifting and lowering a light load without any trouble. In this case, the above operation for rotating the knob 3 in the brake clamping direction is not necessarily needed, because a next operation of the lever 36 causes the knob 3 to move into the brake clamping direction. Furthermore, the rod of the anchor operating means 6 extends from the circumferential surface of the knob 3 in the operating condition of the braking assembly higher than in the idling condition, so that the visible extending height of the rod 24 of the anchor operating means 6 serves to distinguish whether the brake assembly is in the idling or clamped condition with ease.

While the invention has been particularly shown and described with reference to preferred embodiments thereof, it will be understood by those skilled in the art that the foregoing and other changes in form and details can be made therein without departing from the spirit and scope of the invention.

What is claimed is:

1. An idling device for a lever hoist comprising; a change gear provided on a driving member threadedly engaged on a driving shaft for driving a sheave winding up a chain, rope or the like thereabout for a load, an operating lever rockable about said driving member by

United States Patent [19]

Maeda

[11] Patent Number: 4,474,360

[45] Date of Patent: Oct. 2, 1984

[54] IDLING DEVICE FOR LEVER HOIST

[75] Inventor: Kazuo Maeda, Yokohama, Japan

[73] Assignee: Kabushiki Kaisha Kito, Kawasaki, Japan

[21] Appl. No.: 473,302

[22] Filed: Mar. 8, 1983

[30] Foreign Application Priority Data

Jun. 9, 1982 [JP] Japan ..... 57-97577

[51] Int. Cl.[3] ..... B66D 1/14; B66D 1/42

[52] U.S. Cl. ..... 254/350; 254/353; 254/357; 254/372

[58] Field of Search ..... 254/217, 218, 350, 352, 254/353, 354, 369, 376, 372

[56] References Cited

U.S. PATENT DOCUMENTS

| | | | |
|---|---|---|---|
| 3,047,114 | 7/1962 | Stevens | 254/352 X |
| 3,100,031 | 8/1963 | Lock | 254/352 X |
| 3,776,514 | 12/1973 | Eggleton | 254/369 |

*Primary Examiner*—Stuart S. Levy
*Assistant Examiner*—Joseph J. Hail, III
*Attorney, Agent, or Firm*—Sughrue, Mion, Zinn, Macpeak, and Seas

[57] ABSTRACT

An idling device is able to bring a lever hoist into an idling condition including a change gear provided on driving member threadedly engaged on a driving shaft for driving a sheave for winding-up a chain or rope for a load, an operating lever rockably driven by a hand, winding-up and winding-off driving pawls engageable with teeth of the change gear and changeable for hoisting or lowering the load, and a braking assembly for preventing the change gear from being driven by the gravitational force of the load and adapted to be clamped and released by rotative movement of the driving member relative to the driving shaft. According to the invention, the idling device comprises an anchoring member fixed at one end of the driving shaft, a manually operatable knob rotatably and axially slidably fitted on the driving shaft between the anchoring member and the driving member for manually driving the driving member from a brake clamping position to a brake releasing position, and anchor operating member fitted in an aperture formed in the knob and radially slidable therein toward and away from the anchoring member to clamp and release the knob relative to the driving shaft, thus enabling the lever hoist braking assembly to be maintained in the released condition and to be changed from the released condition into the clamped condition.

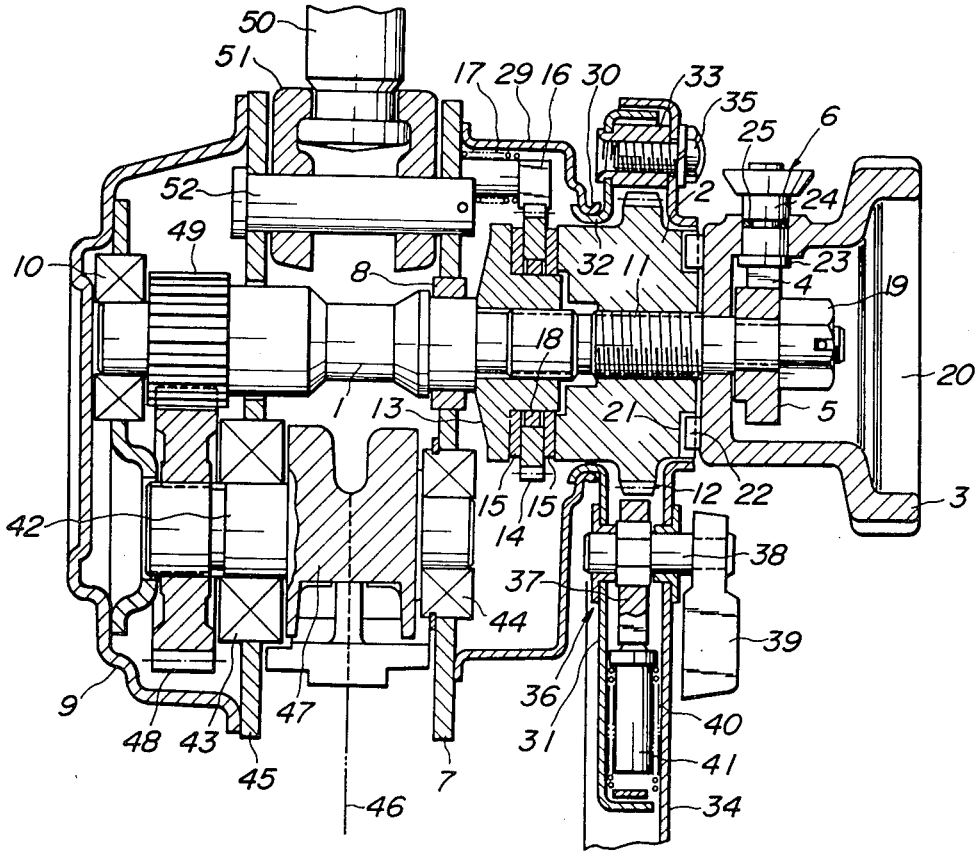

3 Claims, 5 Drawing Figures